US007506784B2

(12) United States Patent
Lee

(10) Patent No.: US 7,506,784 B2
(45) Date of Patent: Mar. 24, 2009

(54) SPOUT ASSEMBLY WITH VERTICALLY MOVABLE SPOUTING GUIDE MEMBER

(76) Inventor: Jung Min Lee, #1208 Misung APT, A-dong, 37 Yeouedo-dong, Youngdungpo-gu, 150-010 Seoul (KR)

( * ) Notice: Subject to any disclaimer, the term of this patent is extended or adjusted under 35 U.S.C. 154(b) by 117 days.

(21) Appl. No.: 10/547,822

(22) PCT Filed: Mar. 3, 2004

(86) PCT No.: PCT/KR2004/000450

§ 371 (c)(1),
(2), (4) Date: Sep. 2, 2005

(87) PCT Pub. No.: WO2004/078600

PCT Pub. Date: Sep. 16, 2004

(65) Prior Publication Data

US 2006/0273119 A1 Dec. 7, 2006

(30) Foreign Application Priority Data

Mar. 3, 2003 (KR) ..... 10-2003-0014191
Jan. 15, 2004 (KR) ..... 10-2004-0004030
Jan. 19, 2004 (KR) ..... 10-2004-0004883

(51) Int. Cl.
*B67D 3/00* (2006.01)

(52) U.S. Cl. ..... 222/525; 222/541.1; 206/222; 215/6

(58) Field of Classification Search ..... 206/219, 206/222; 222/520, 52, 219, 525, 89, 90, 222/492, 493, 499, 541.1, 541.2, 541.7, 541.9, 222/566–570, 80–91, 541.4–541.6; 215/6; 220/521–523

See application file for complete search history.

(56) References Cited

U.S. PATENT DOCUMENTS

| | | | | | |
|---|---|---|---|---|---|
| 3,511,420 | A * | 5/1970 | Kessler | 222/525 |
| 3,924,741 | A * | 12/1975 | Kachur et al. | 206/221 |
| 4,203,517 | A * | 5/1980 | Hildebrandt et al. | 206/221 |
| 4,667,853 | A * | 5/1987 | Kruger | 222/80 |
| 4,813,578 | A * | 3/1989 | Gordon et al. | 222/541.1 |
| 4,884,705 | A * | 12/1989 | Debetencourt | 222/83 |
| 5,052,595 | A * | 10/1991 | Mon | 222/525 |
| 5,094,361 | A * | 3/1992 | Dubach | 222/81 |
| 5,489,050 | A * | 2/1996 | Finkiewicz et al. | 222/525 |
| 6,170,654 | B1 * | 1/2001 | Gartner et al. | 206/219 |
| 6,257,463 | B1 * | 7/2001 | De Polo | 222/525 |

FOREIGN PATENT DOCUMENTS

| | | |
|---|---|---|
| JP | 3048395 Y | 2/1998 |
| JP | 3058143 Y | 3/1999 |
| JP | 3066386 Y | 11/1999 |
| KR | 20-0304756 | 2/2003 |
| KR | 2003-0015185 | 2/2003 |

* cited by examiner

*Primary Examiner*—Lien T Ngo
(74) *Attorney, Agent, or Firm*—Westman, Champlin & Kelly, P.A.

(57) ABSTRACT

A spout assembly includes a main body coupled on an opening of a container, a lip portion formed on the main body, having an operating portion and a coupling portion, a spouting guide installed in the operation portion of the lip portion, being vertically movable, and an upper cap coupled on the coupling portion to provide seal to the main body. The lip portion is provided with a seal projection having a side exhaust hole, the seal projection sealing a lower end of the spouting guide, and the spouting guide.

14 Claims, 11 Drawing Sheets

[FIG 1]
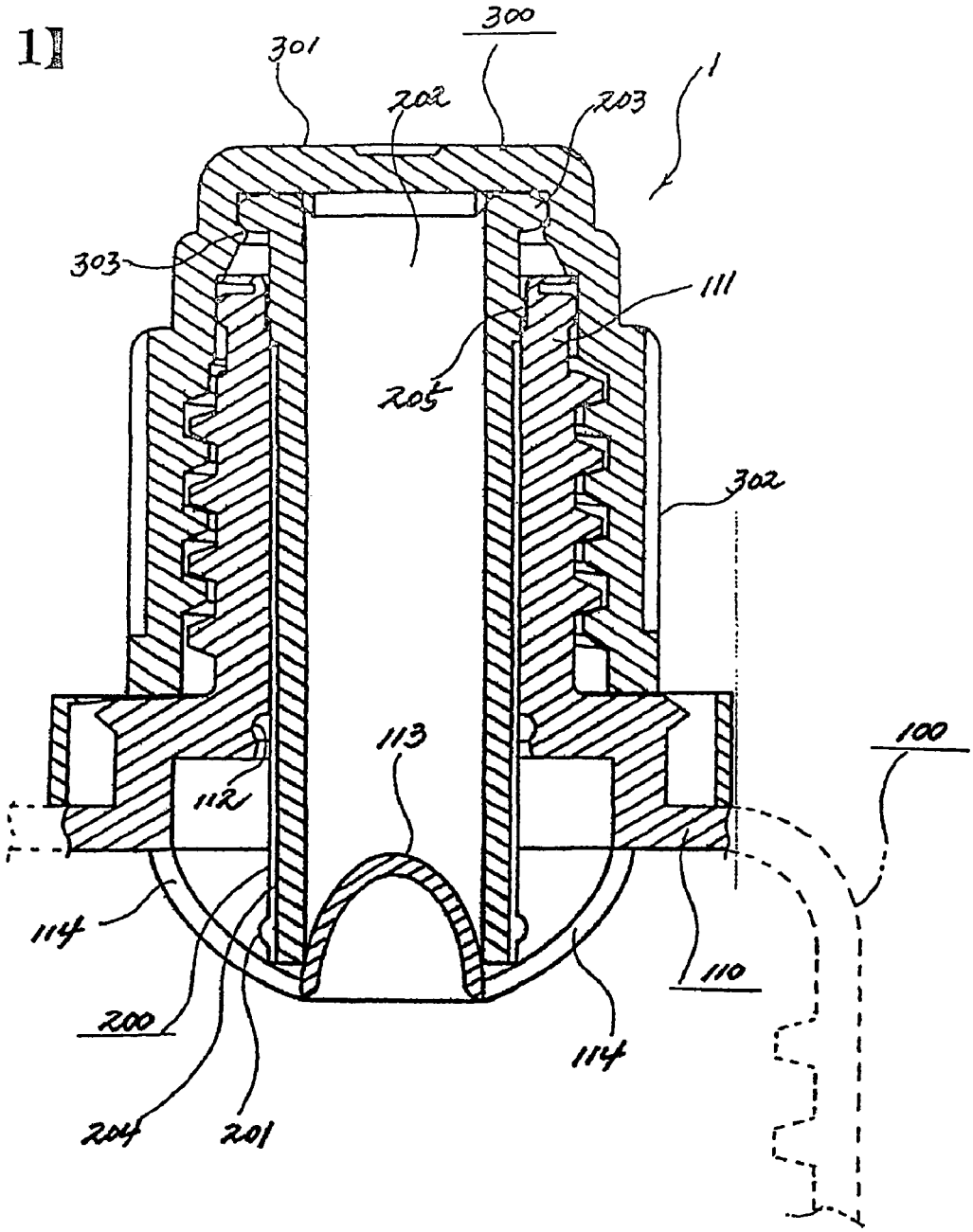

[FIG 2]
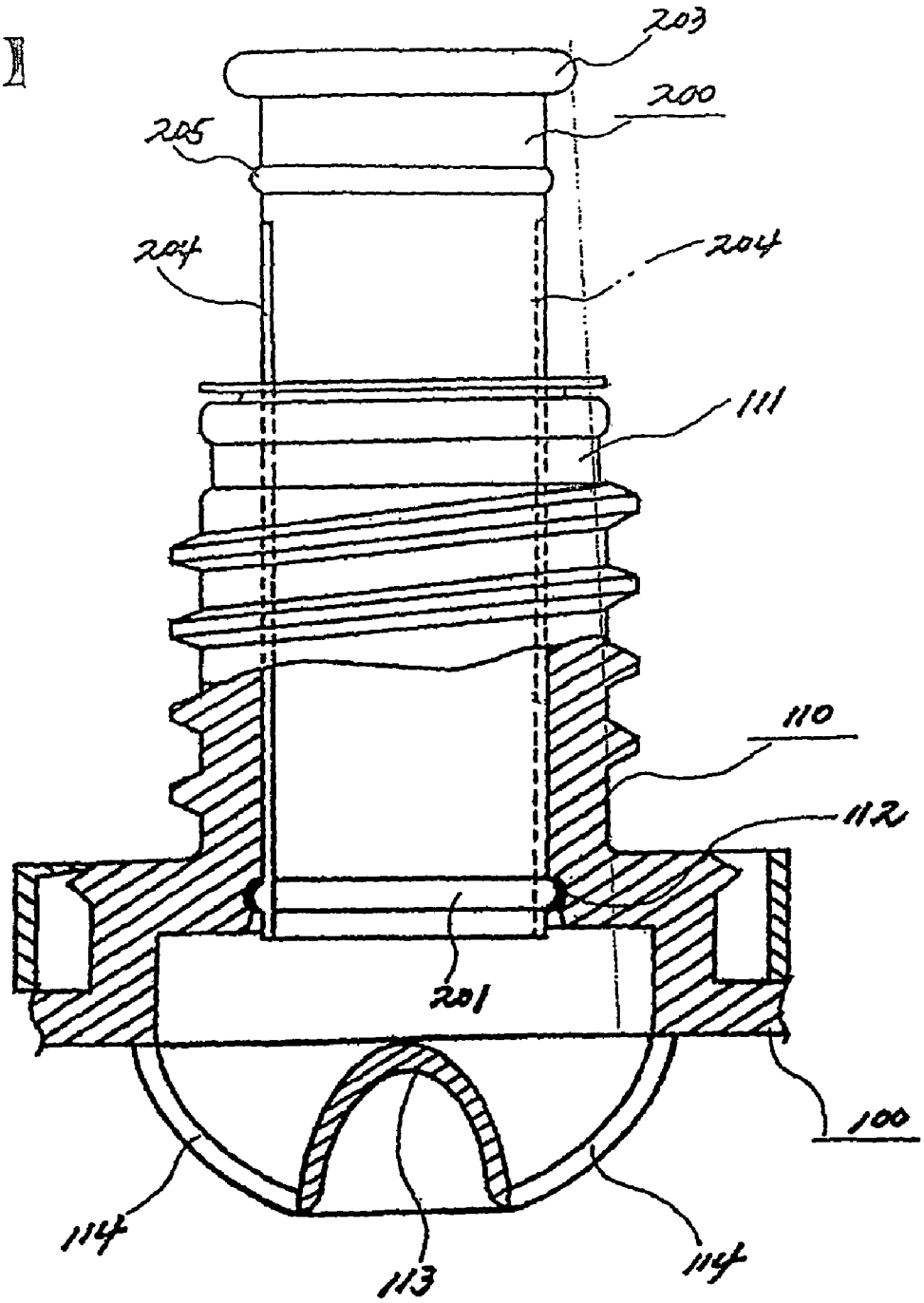

[FIG 3]
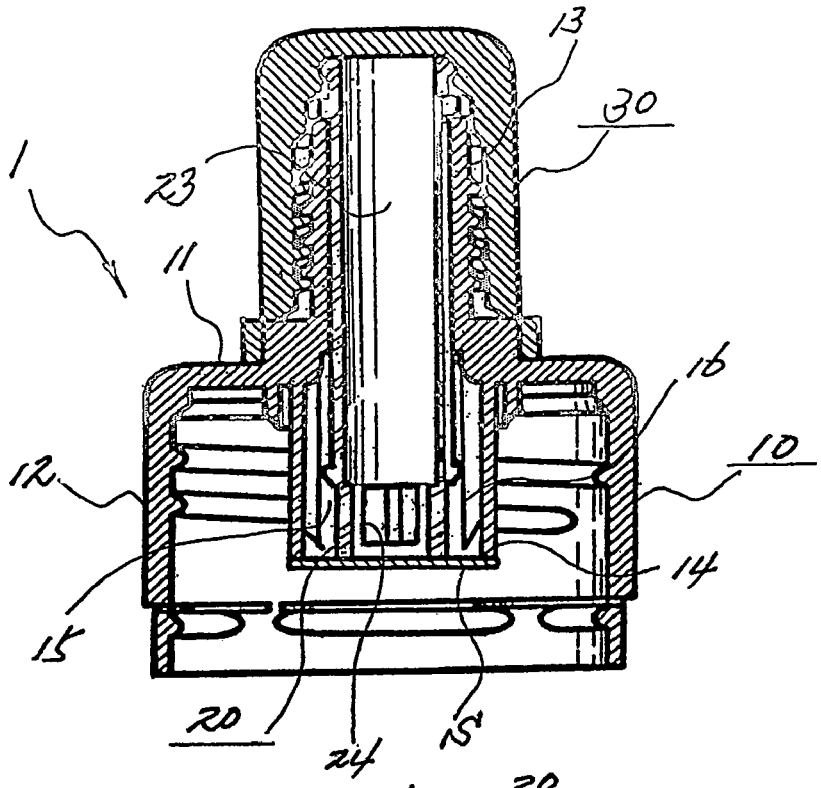
[FIG 4]
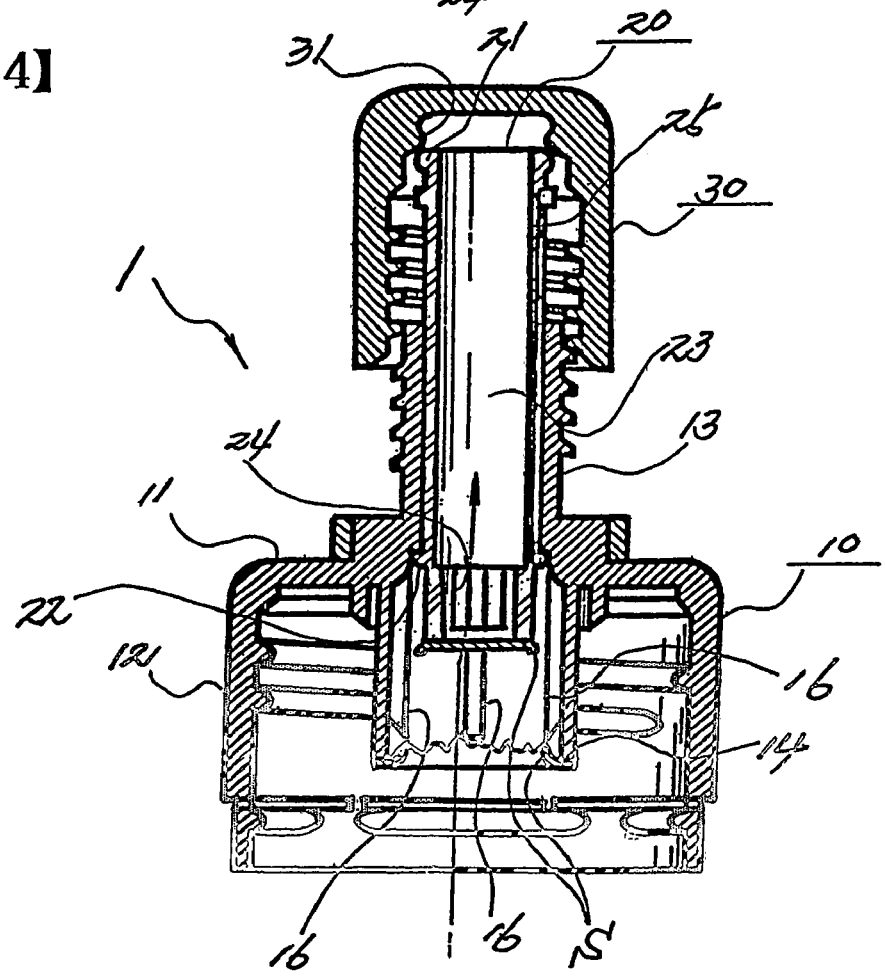

【FIG 5】
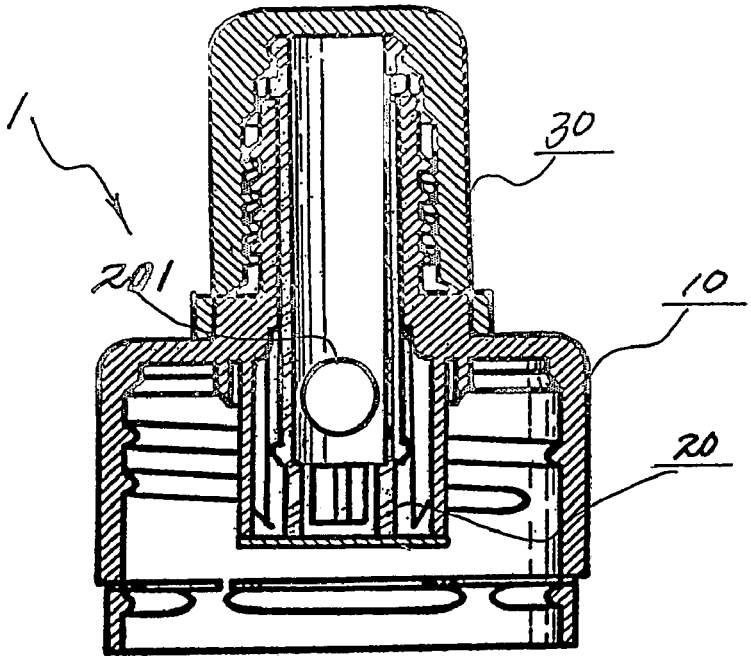
【FIG 6】
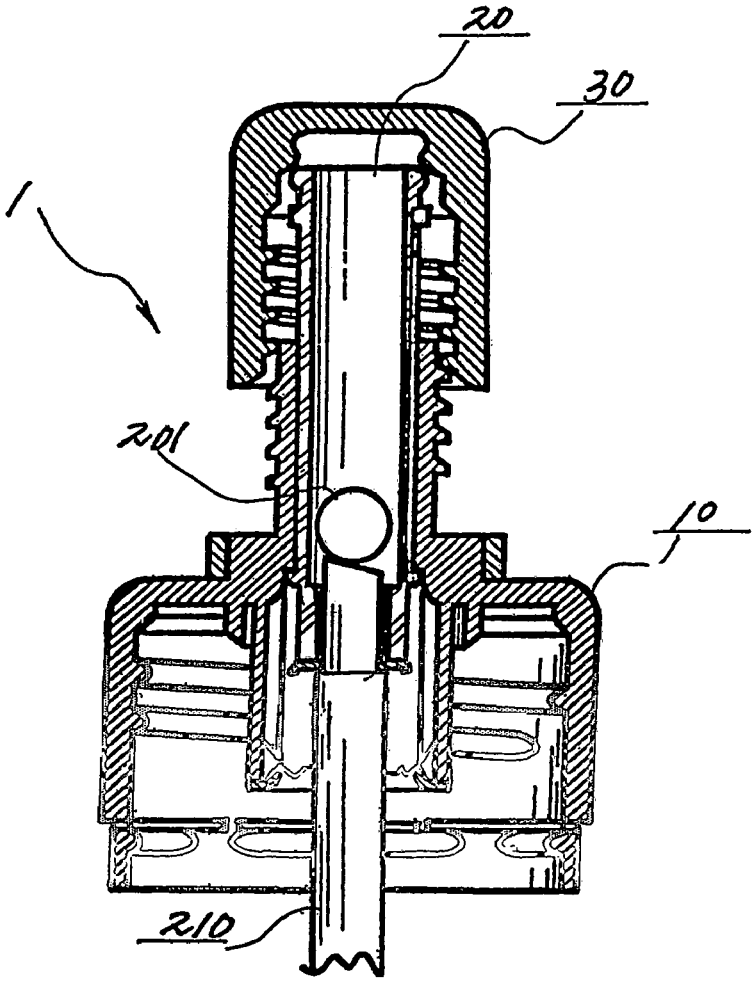

[FIG 7]
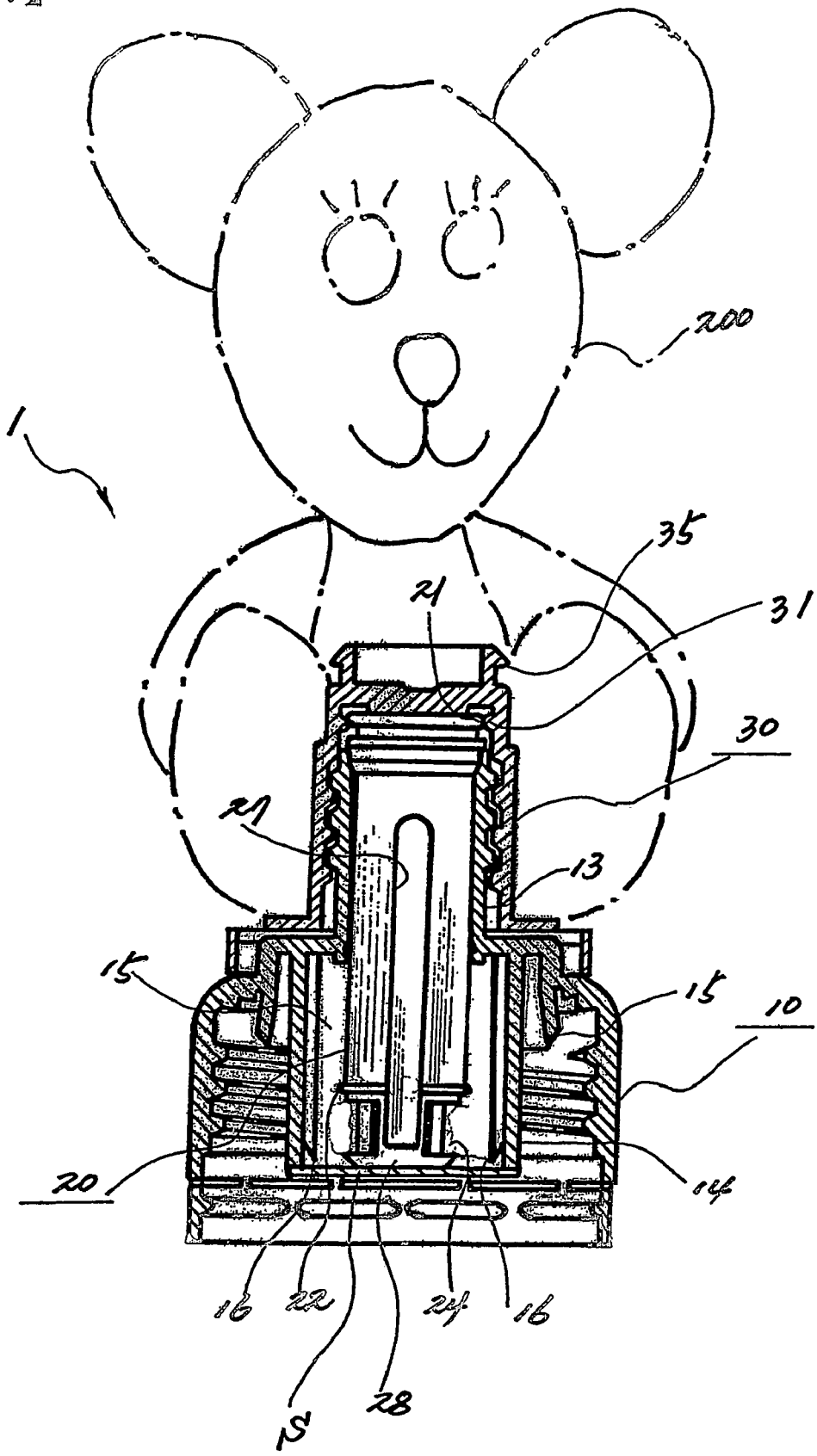

[FIG 8]
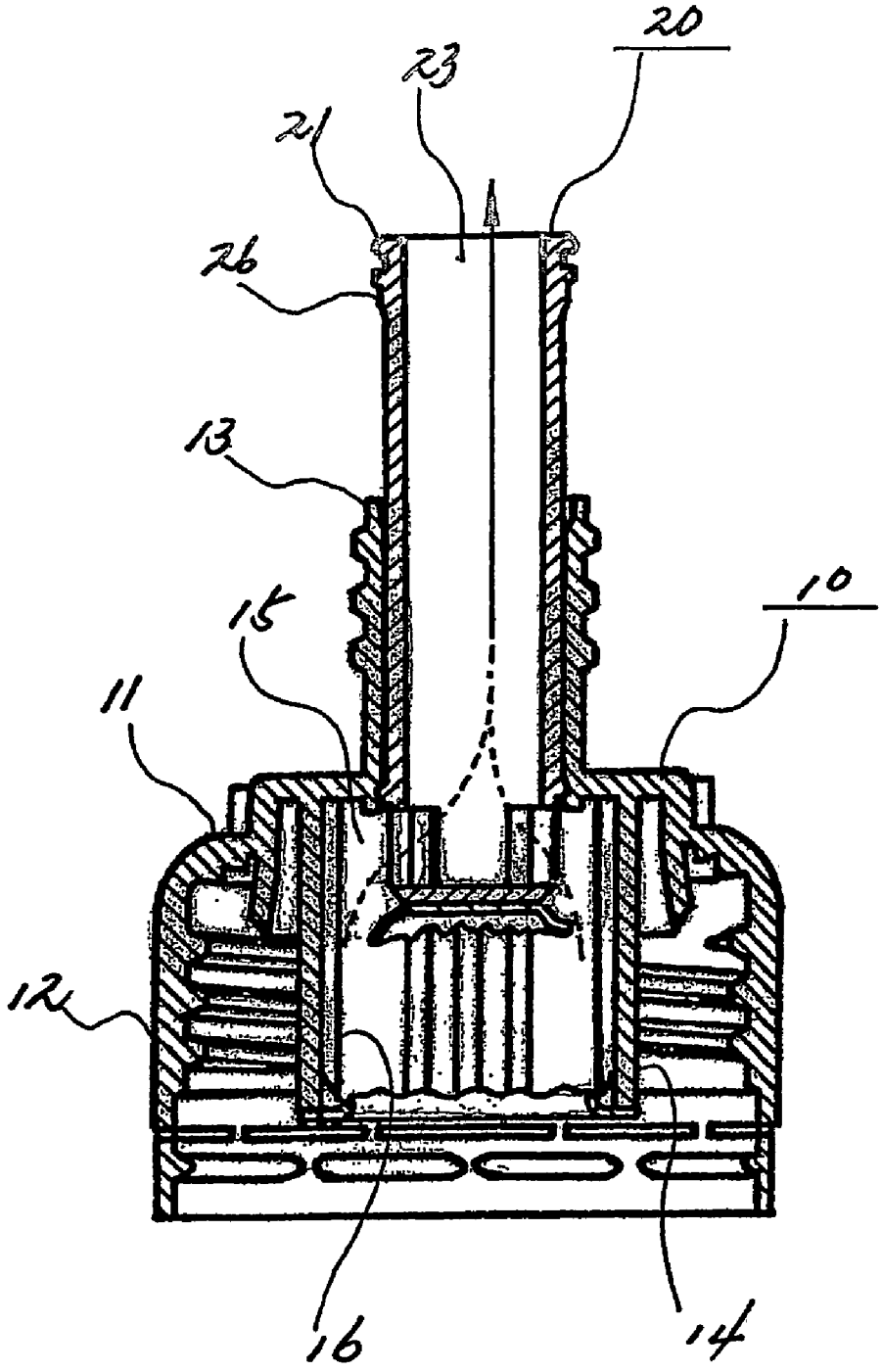

[FIG 9]
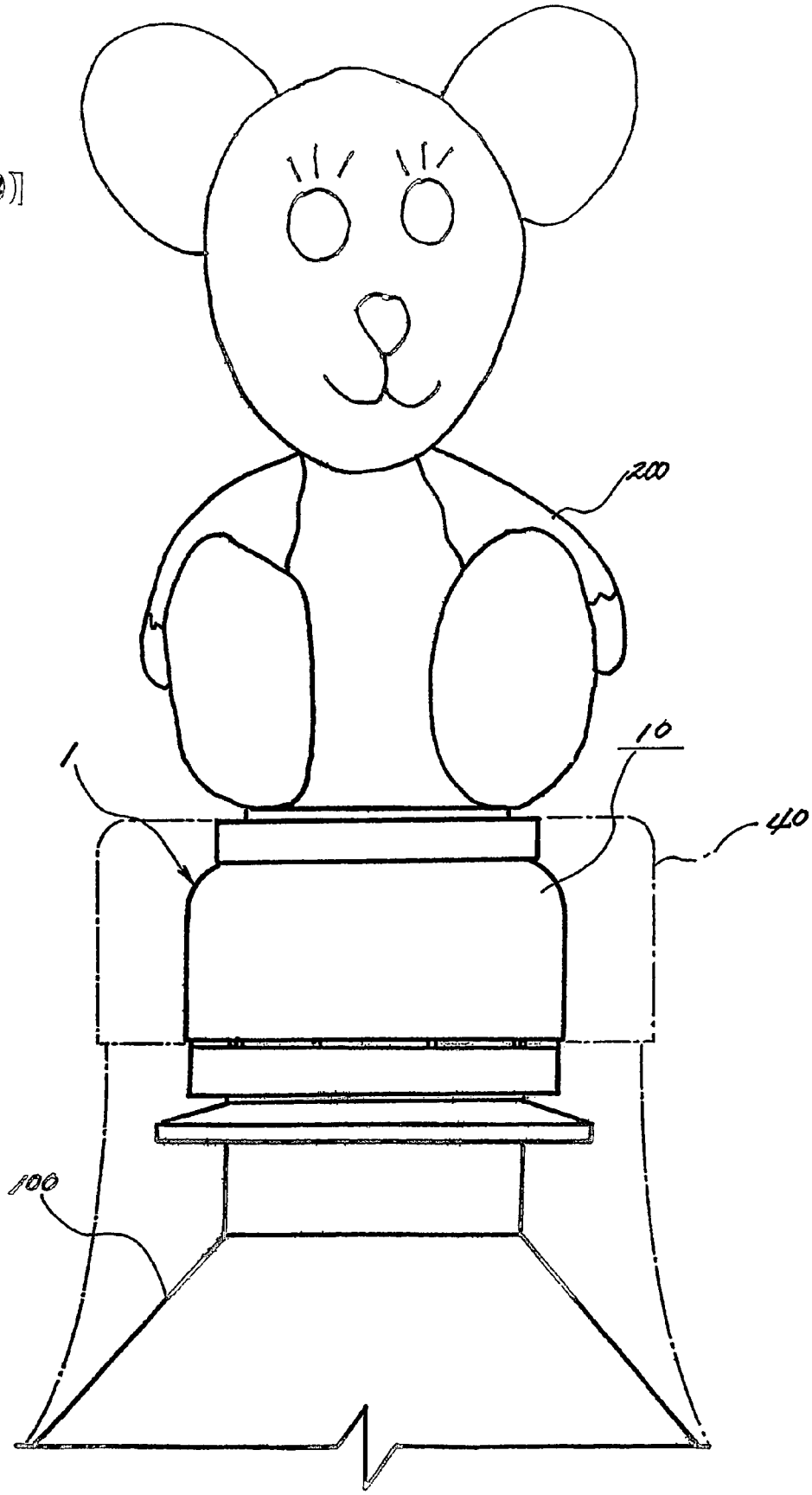

[FIG 10]
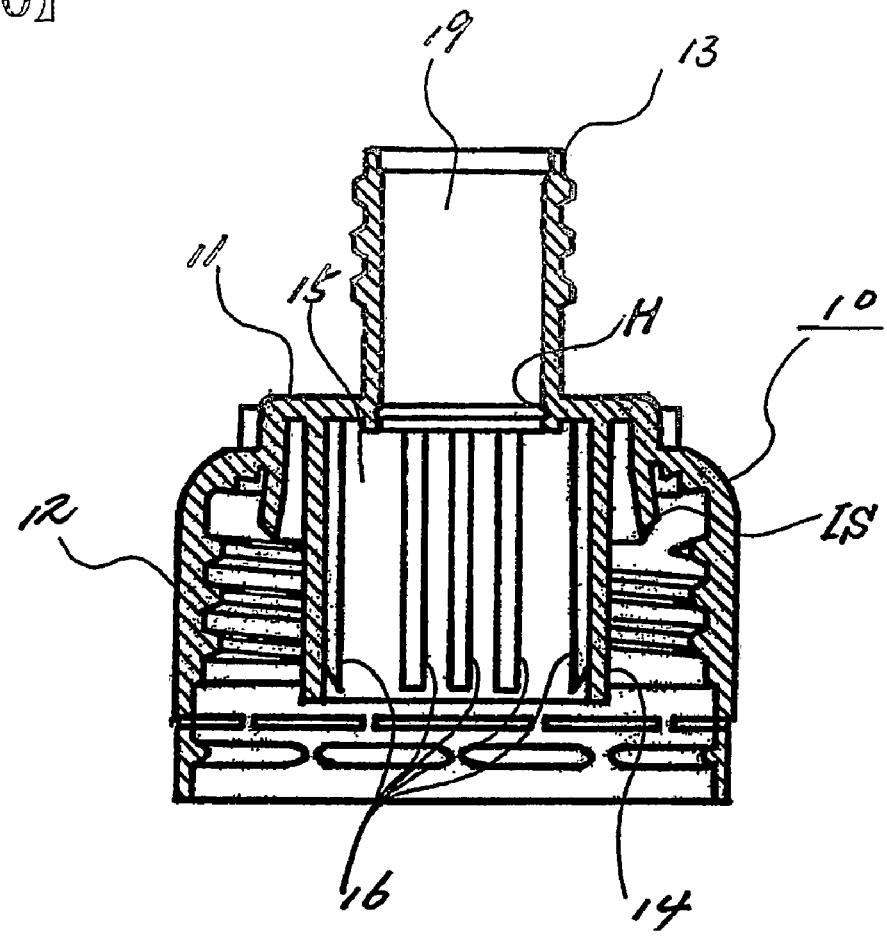
[FIG 11]
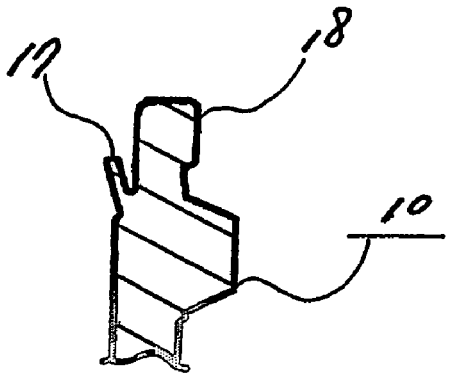

[FIG 12]
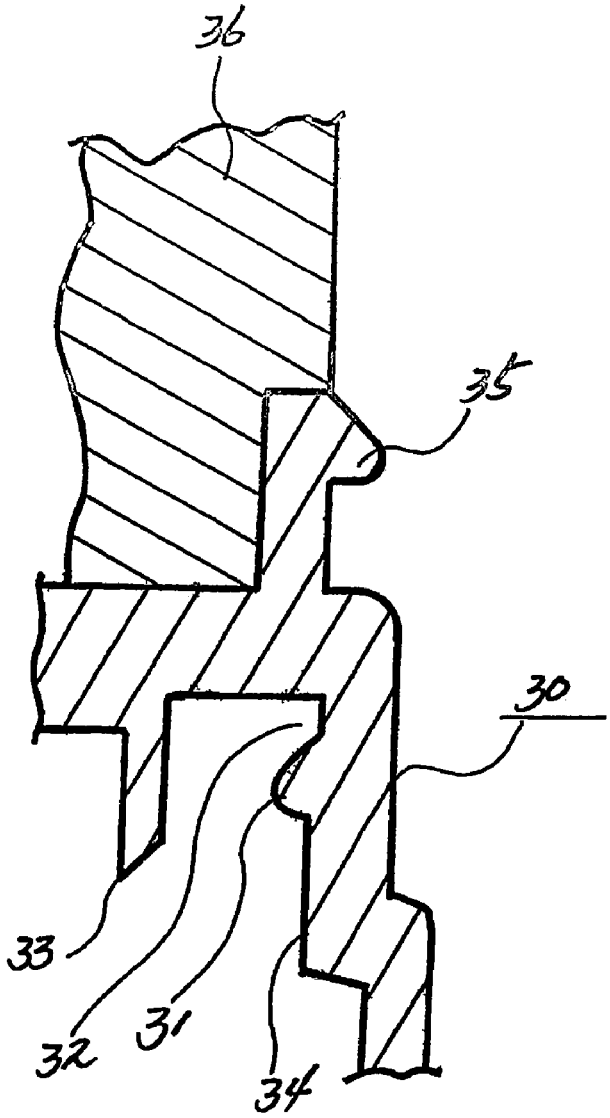
[FIG 13]
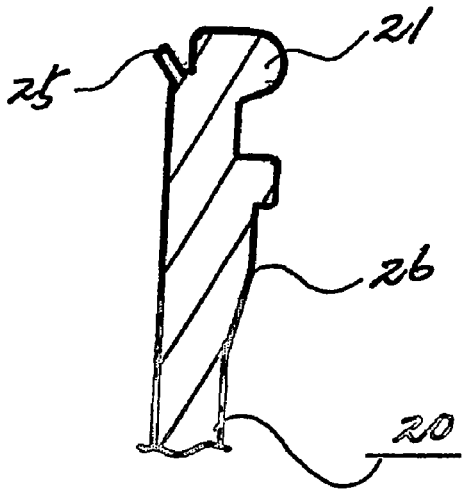

[FIG 14]
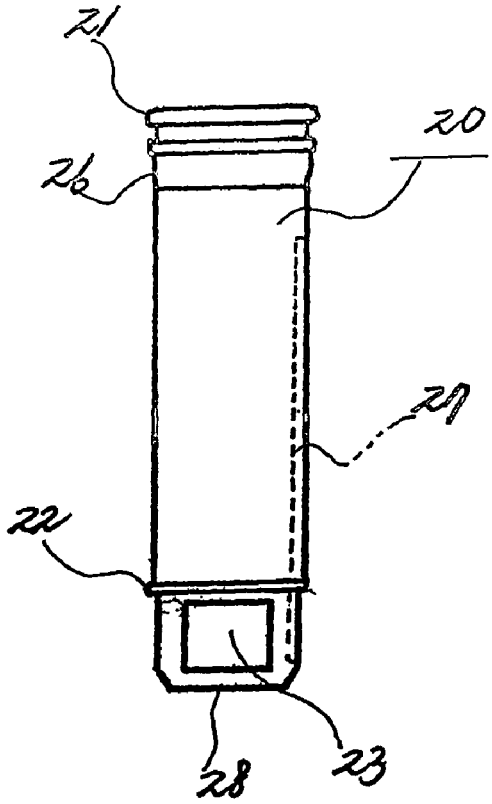
[FIG 15]
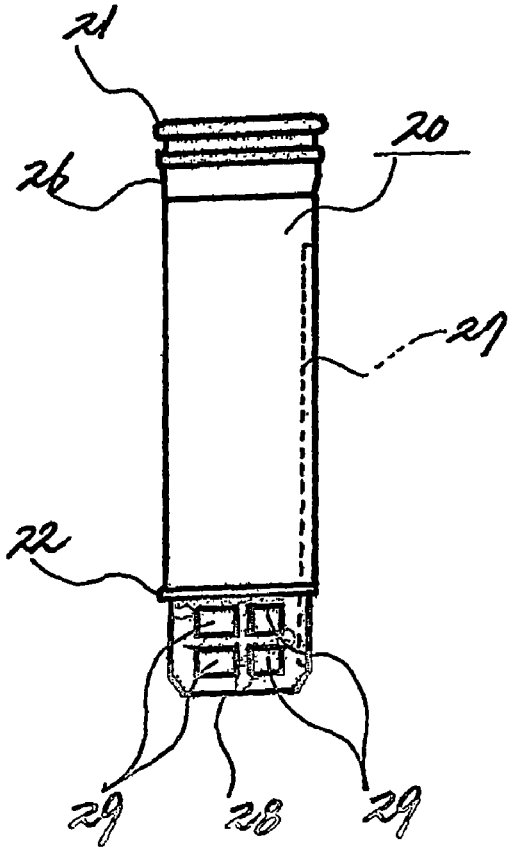

[FIG 16]
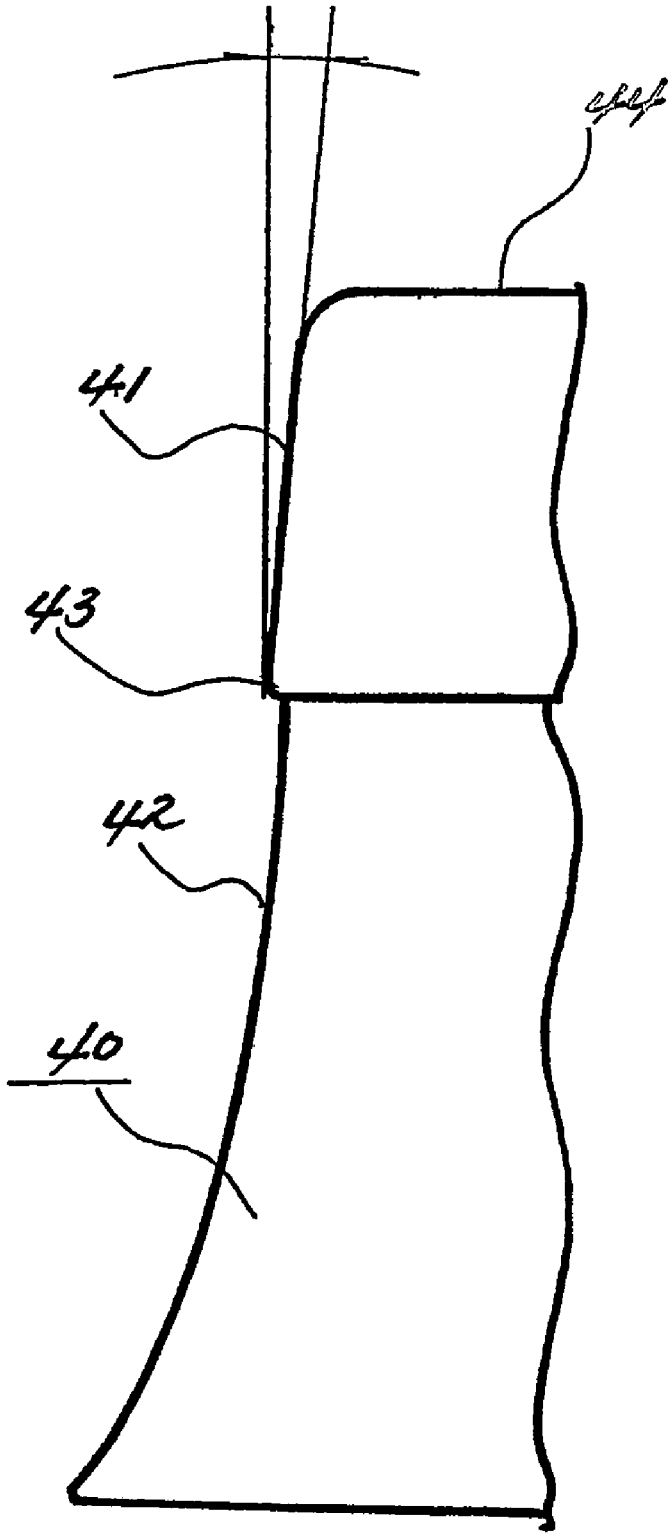

SPOUT ASSEMBLY WITH VERTICALLY MOVABLE SPOUTING GUIDE MEMBER

CROSS-REFERENCE TO RELATED APPLICATION

This Application is a Section 371 National Stage Application of International Application No. PCT/KR2004/000450, filed Mar. 3, 2004 and published as WO 2004/078600 A2 on Sep. 16, 2004, in English.

TECHNICAL FIELD

The present invention relates to a spout assembly with a vertically movable spouting guide member, and more particularly, to a spout assembly that can store special contents such as powder or other liquid and allow the special contents to be mixed with liquid contained in a container where the spout assembly is assembled.

BACKGROUND ART

U.S. Pat. No. 6,435,383 discloses a spout assembly that can make it possible for a user to suck and dispense the contents in the container.

The present invention provides a spout assembly that can store special contents such as powder or other liquid and allow the special contents to be mixed with liquid contained in a container where the spout assembly is assembled, while still having the function disclosed in the U.S. Patent.

SUMMARY OF THE INVENTION

Therefore, the present invention has made in an effort to solve the above-described problems of the conventional art.

It is an objective of the present invention to provide a spout assembly that can store special contents such as powder or other liquid concentration and allow the special contents to be mixed with liquid contained in a container where the spout assembly is assembled.

To achieve the above object, the present invention provides a spout assembly comprising a main body coupled on an opening of a container; a lip portion formed on the main body, having an operating portion and a coupling portion; a spouting guide installed in the operation portion of the lip portion, being vertically movable; and an upper cap coupled on the coupling portion to provide seal to the main body, wherein the lip portion is provided with a seal projection having a side exhaust hole, the seal projection sealing a lower end of the spouting guide, and the spouting guide.

According to another aspect of the present invention, there is provided a spout assembly comprising a main body coupled on a container; a spouting member movably mounted on the main body; an upper cap sealing the spouting member and the main body; and a supporting member formed on a bottom of the main body, defining a space, wherein a lower end of the supporting member and a lower end of the spouting member are sealed by a thin film.

According to still another object of the present invention, there is provided a spout assembly comprising a main body coupled on a container; a spouting member movably mounted on the main body; an upper cap sealing the spouting member and the main body; a supporting member formed on a bottom of the main body, defining a space, wherein a lower end of the spouting member is located in the space and the space is opened when the spouting member is moved upward.

According to still another object of the present invention, there is provided a spout assembly comprising a main body coupled on a container; a spouting member movably mounted on the main body; an upper cap sealing the spouting member and the main body; a supporting member formed on a bottom of the main body, defining a space, wherein a lower end of the spouting member is located in the space, the space is opened when the spouting member is moved upward, and the supporting portion is provided with a seal portion that is broken when the spouting portion is moved upward.

According to still yet another aspect of the present invention, there is provided a spout assembly comprising: a main body coupled on a container; a spouting member movably mounted on the main body; an upper cap sealing the spouting member and the main body; a supporting member formed on a bottom of the main body, defining a space, wherein a lower end of the spouting member is located in the space, the space is opened when the spouting member is moved upward, the supporting portion is provided with a seal portion that is broken when the spouting portion is moved upward, and the space stores powder or concentration that will be mixed with content in the container when the space is opened.

BRIEF DESCRIPTION OF THE DRAWINGS

FIG. 1 is a sectional view of a spout assembly according to an embodiment of the present invention;

FIG. 2 is a partial sectional view illustrating an operation state of the spout assembly depicted in FIG. 1;

FIG. 3 is a spout assembly according to a second embodiment of the present invention;

FIG. 4 is a partial sectional view illustrating an operation state of the spout assembly depicted in FIG. 3;

FIG. 5 is a modified example of FIG. 2;

FIG. 6 is a partial sectional view illustrating an operation state of the spout assembly depicted in FIG. 5;

FIG. 7 is a spout assembly according to a third embodiment of the present invention;

FIG. 8 is a partial sectional view illustrating an operation state of the spout assembly depicted in FIG. 3;

FIG. 9 is a view illustrating an application state of the spout assembly to a container;

FIG. 10 is a sectional view of FIG. 7;

FIG. 11 is a partial enlarged view of FIG. 7;

FIG. 12 is an enlarged view of an upper cover;

FIG. 13 is a partial enlarge view of a spout assembly;

FIG. 14 is a front view of a spout assembly;

FIG. 15 is a view of another example of a spout; and

FIG. 16 is a view of a portion of an outer cover.

BEST MODE FOR CARRYING OUT THE INVENTION

Preferred embodiments of the present invention will be described more in detail hereinafter in conjunction with the accompanying drawings.

FIGS. 1 and 2 shows a spout assembly according to a first embodiment of the present invention.

As shown in the drawings, the inventive spout assembly 1 comprises a lip contacting main body 100 and a spouting guide 200 installed in a lip portion 110 of the main body 100.

A cap 300 is disposed covering the lip portion 110 and the spouting guide 200.

The main body 100 is designed to be adapted to a variety of container necks.

The main body 100 is provided with an operating portion 111 for receiving the spouting guide 200 and a screw or hook step formed on an outer portion of the operating portion 111.

The spout guide 200 is designed to move contacting an inner wall of the operating portion 111. The spouting guide 200 is provided at a lower end with a circumferential projection 201 limiting the vertical movement of the spouting guide in a limited range. The operating portion 111 is provided at a lower end of the inner wall with a circumferential groove 112 in which the circumferential projection 201 is hooked so that the spouting guide 200 cannot move unless there is not outer force.

The location of the circumferential projection 201 can be varied as far as it can prevent the spouting guide from further moving after the spouting guide moved by a predetermined distance.

The spouting guide 200 is further provided at an upper end with a hook projection 203 and a seal surface under the hook projection 203. An air intake portion 204 is formed on an outer surface of the spouting guide 200.

The cap 300 is assembled around the spouting guide 200 assembled on the operating portion 111.

The cap 300 has a top portion 301 and a circumferential side portion 302. The circumferential side portion 302 is provided at an upper end of an inner wall of the circumferential side portion 302 with a hook circumferential projection 303 for lifting the spouting guide portion. The inner wall of the circumferential side portion 302 is provided with a screw corresponding to the screw formed on the outer surface of the operating portion 111.

A seal projection 113 for sealing a lower portion of the spouting guide 200 is provided under the lip portion 110. The seal projection 113 is provided with a side exhaust hole 114 so that the content in the container can flow through the side exhaust hole 114 when the spouting guide 200 is lifted.

The operation of the above-described spout assembly will be described hereinafter.

In use, when the cap 300 is removed, since the circumferential hook projection 303 is engaged with the hook projection 203, the spouting guide 200 moves upward. At this point, a lower portion of the spouting guide starts being spaced away from the seal projection 113.

In the course that the cap 300 is removed from the operating portion 111 of the lip portion 110, when the circumferential projection 201 of the spouting guide 200 is hooked not to move upward any more, the circumferential hook projection 303 is disengaged from the hook projection 203 of the spouting guide 200.

The above state is shown in FIG. 2.

In this state, when the user sucks the upper end of the spouting guide 200 in a state where the container is inclined in a direction, the content in the container can be exhausted through a side exhaust hole 114 and an exhaust hole 202. While the content is exhausted, air is introduced into the container through the air intake portion 204, thereby allowing the user to drink the contents without squeezing the container.

The vertical motion of the spouting guide 200 can be also realized using fingers.

As shown in FIG. 1, an enclosed space defined by the spouting guide 200 and the seal projection 113 is designed to receive powder or concentration.

Accordingly, as shown in FIG. 2, when the spouting guide 200 is moved upward, the powder or concentration can be dropt in the container to be mixed with the content in the container.

FIGS. 3 and 4 show a spout assembly according to a second embodiment of the present invention.

As shown in the drawings, the spout assembly 1 comprises a main body 10, a spouting member 20, an upper cap 30 for sealing the main body 10 and the spouting member 20.

For example, the main body 10 comprises a top portion 11 and a side portion 12. A lip portion 13 is formed extending from the top portion 11 upward. A supporting portion 14 defining a space is formed extending from a bottom of the top portion 11.

The spouting member 20 is coupled in the lip portion 13. The spouting member 20 is provided at upper and lower portions with stoppers so that the spouting member 20 is not separated from the lip portion 13.

The spouting member 20 coupled in the lip portion 13 is moved upward and downward by the upper cap 30. For example, the spouting member 20 is provided at an upper portion with a circumferential projection 21 engaged with a circumferential step 31 of the upper cap 30. Therefore, when the upper cap 30 is screw-opened, the spouting member 20 moves upward together with the upper cap 30. Then, when a hook projection formed on a lower portion of the spouting member 20 is hooked on the bottom of the lip portion 13, the circumferential projection 22 is disengaged with the circumferential step 31.

When the spouting member 20 is coupled in the lip portion 13, the lower end of the spouting member 20 and the lower end of the supporting portion 14 are sealed by a seal film S such as aluminum foil.

Therefore, when the spouting member 20 moves upward by the upper cap, the seal film S is broken. To this end, a plurality of punching projections are formed on an inner wall of the supporting portion 14.

The spouting member 20 is provided with a side exhaust hole 24 communicating with a main exhaust hole 23.

The operation of this embodiment will be described hereinafter.

For example, the main body 10 is coupled on a neck of a container. In this state, when the upper cap 30 is rotated in an opening direction, the spouting member 20 moves upward, in the course of which the seal film S is broken by the punching projections 16 to open the space 15.

When the upper cap 30 is further rotated, the spouting member 20 is not moved upward any more. In this state, when the upper cap 30 is further rotated, the upper cap 30 is completely separated from the spouting member 20 and the lip portion 13.

The above process is shown in FIG. 4. In use, when the container is inclined in a direction, the content in the container is exhausted through the side exhaust hole 24 and the exhaust hole 23. At this point, an air intake portion 25 is formed on an outer surface of the exhaust member 20.

The space 15 may receive powder or concentration which will be mixed with the content contained in the container when the seal film is broken.

Alternatively, as shown in FIGS. 5 and 6, a movable spouting member 20 is provided with a sub-side exhaust hole 201 and a sub-spouting member 210 is assembled on the spouting member 20 as shown in FIG. 6.

When the spouting member 20 moves upward, the sub-side exhaust hole 201 is closed by the inner wall of the lip portion 13. When suck the spouting member 20 in this state, the content in the container is exhausted through the sub-exhaust member 210.

When the spouting member 20 moves downward, the sub-side exhaust hole 201 is opened so that the content can be exhausted through the sub-side exhaust hole 201.

Likewise, the space in the spouting member can receive powder or concentration that will be mixed with the content when the spouting member is lifted.

FIGS. 7 through 16 shows a spout assembly according to a third embodiment of the present invention.

As shown in the drawing, the spout assembly 1 a main body 10, a spouting member 20, an upper cap 30 for sealing the main body 10 and the spouting member 20.

For example, the main body 10 comprises a top portion 11 and a side portion 12. A lip portion 13 is formed extending from the top portion 11 upward. A supporting portion 14 defining a space is formed extending from a bottom of the top portion 11.

The spouting member 20 is coupled in the lip portion 13. The spouting member 20 is provided at upper and lower portions with stoppers so that the spouting member 20 is not separated from the lip portion 13.

The spouting member 20 coupled in the lip portion 13 is moved upward and downward by the upper cap 30. For example, the spouting member 20 is provided at an upper portion with a circumferential projection 21 engaged with a circumferential step 31 of the upper cap 30. Therefore, when the upper cap 30 is screw-opened, the spouting member 20 moves upward together with the upper cap 30. Then, when a hook projection formed on a lower portion of the spouting member 20 is hooked on the bottom of the lip portion 13, the circumferential projection 22 is disengaged with the circumferential step 31.

When the spouting member 20 is coupled in the lip portion 13, the lower end of the spouting member 20 and the lower end of the supporting portion 14 are sealed by a seal film S such as aluminum foil.

Therefore, when the spouting member 20 moves upward by the upper cap, the seal film S is broken. To this end, a plurality of punching projections are formed on an inner wall of the supporting portion 14.

The spouting member 20 is provided with a side exhaust hole 24 communicating with a main exhaust hole 23.

In order to enhance seal force, the lip portion 13 is provided at an upper inner wall with an elastic member 17 and at an outer circumference with a lip sealing portion 18. The lip portion 13 is further provided with a hook projection inserting groove H to prevent the spouting member 20 from moving upward above a predetermined distance.

An inner closer IS that can be tightly contact the inner wall of the container neck is formed on an outer circumference of the supporting portion 14.

The spouting member 20 is provided with an elastic member 25 for sealing the inner wall of the spouting member 20. The spouting member 20 is provided at an outer circumference with a seal wall 26 corresponding to the elastic member 17.

The spouting member 20 is provided with a seal attaching portion 28 having a hole.

The upper cap 20 is provided with a circumferential groove 32 engaging with the circumferential projection 21 of the spout member 20 and an inner closer 33 corresponding to the elastic member 24.

The upper cap 30 is provided with a seal wall 34 corresponding to a seal portion 18 of the lip potion. The upper cap 30 is further provided at a top with a fitting hook 35 on which other object such as a character doll can be fitted.

As shown in FIG. 12, a central portion of the fitting hook 35 is concaved for the injection molding. That is, an operation core 36 enables for the fitting hook 35 to be formed in the injection molding.

The character doll 200 is provided with a fitting portion that will be hooked in the fitting hook 35.

In order to securely fix the character doll 200, there is provided an outer cover 40 disposed around the main body 10 of the spout assembly 1. The outer cover 40 is formed in a truncated funnel shape. The outer cover 40 is provided with a hook 43 hooked on the main body 10.

The operation of the above described spout assembly will be described hereinafter.

The main body 10 is coupled on the neck of the container 100. In use, the upper cap 30 is rotated in an opening direction, in the course of which the seal film S is broken by the punching projection 16 and the space 15 is opened.

When the upper cap 30 is further rotated, the spouting member 20 moves upward and stops its upward motion by the hook projection inserting groove H of the lip portion. When the cap 30 is further rotated, the upper cap 30 is completely separated from the spouting member 20 and the lip portion 13.

The container is inclined in a direction, the content in the container can be exhausted through a side exhaust hole 24 and an exhaust hole 23. While the content is exhausted, air is introduced into the container through the air intake portion 25, thereby allowing the user to drink the contents without squeezing the container.

After the use, the cap is recapped and the elastic portions 17 and 25 maintain the seal force even after the seal film is broken.

INDUSTRIAL APPLICABILITY

As described above, since the spouting guide member and the operating member can be projected, the user can easily drink the content without the lip contacting the spouting member.

The seal projection enhances the seal force.

Since power and concentration can be stored in the spout assembly, the spout assembly can be applied to a variety of applications.

What invention claimed is:

1. A spout assembly comprising;

a main body coupled on an opening of a container;

a lip portion formed on the main body, having an operating portion and a coupling portion;

a spouting guide installed in the operation portion of the lip portion, being vertically movable between an open position and a sealed position; and an upper cap coupled on the coupling portion to provide seal to the main body, wherein the lip portion is provided with a seal projection having a side exhaust hole, the seal projection sealing a lower end of the spouting guide when in the sealed position, and wherein the spouting guide is releasably coupled to the upper cap, wherein removal of the upper cap from the main body causes vertical movement of the spouting guide from the sealed position to the open position.

2. The spout assembly of claim 1, wherein the spouting guide is provided with a lower end with a circumferential projection to limit the vertical motion to the range.

3. The spout assembly of claim 1, wherein the spouting guide is provided with an air intake portion.

4. A spout assembly comprising:

a main body coupled on a container;

a spouting member movably mounted on the main body between an open position and a sealed position;

an upper cap sealing the spouting member and the main body the spouting member is releasably coupled to the upper cap, wherein removal of the upper cap from the main body causes vertical movement of the spouting member from the sealed position to the open position;

a supporting member formed on a bottom of the main body, defining a space, wherein a lower end of the supporting member and a lower end of the spouting member are sealed by a thin film; and wherein the seal film is broken while the spouting member moves upward to open the space.

5. The spout assembly of claim 4, wherein the spouting member is provided with a side exhaust hole.

6. The spout assembly of claim 5, wherein the lip portion is provided with a hook projection to prevent the spouting member from moving above a predetermined height.

7. The spout assembly of claim 5, wherein the side exhaust hole is formed of minute apertures.

8. A spout assembly comprising:

a main body coupled on a container;

a spouting member movably mounted on the main body between an open position and a sealed position;

an upper cap sealing the spouting member and the main body, the spouting member is releasably coupled to the upper cap, wherein removal of the upper cap from the main body causes vertical movement of the spouting member from the sealed position to the open position;

a supporting member formed on a bottom of the main body, defining a space, wherein a lower end of the spouting member is located in the space and the space is opened when the spouting member is moved upward.

9. The spout assembly of claim 8, wherein the supporting portion is provided with a seal portion that is broken when the spouting portion is moved upward.

10. A spout assembly comprising:

a main body coupled on a container;

a spouting member movably mounted on the main body between an open position and a sealed position;

an upper cap sealing the spouting member and the main body, the spouting member is releasably coupled to the upper cap, wherein removal of the upper cap from the main body causes vertical movement of the spouting member from the sealed position to the open position;

a supporting member formed on a bottom of the main body, defining a space, wherein a lower end of the spouting member is located in the space, the space is opened when the spouting member is moved upward, and the supporting portion is provided with a seal portion that is broken when the spouting portion is moved upward.

11. The spout assembly of claim 10, wherein the spouting member is provided with a side exhaust hole formed of minute apertures.

12. The spout assembly of claim 10, wherein the upper cap is provided at a top with a fitting portion on which an object such as a character doll is fitted.

13. The spout assembly of claim 10, wherein the spouting member is provided with an air intake portion.

14. A spout assembly comprising:

a main body coupled on a container;

a spouting member movably mounted on the main body between an open position and a sealed position;

an upper cap sealing the spouting member and the main body, the spouting member is releasably coupled to the upper cap, wherein removal of the upper cap from the main body causes vertical movement of the spouting member from the sealed position to the open position;

a supporting member formed on a bottom of the main body, defining a space, wherein a lower end of the spouting member is located in the space, the space is opened when the spouting member is moved upward, the supporting portion is provided with a seal portion that is broken when the spouting portion is moved upward, and the space stores powder or concentration that will be mixed with content in the container when the space is opened.

* * * * *